US012774134B2

(12) United States Patent
Jung et al.

(10) Patent No.: US 12,774,134 B2
(45) Date of Patent: Oct. 27, 2026

(54) ROTATIONAL OPENING/CLOSING STRUCTURE OF COVER FOR PACKAGING CONTAINER HAVING NON-CIRCULAR-SHAPED INLET

(71) Applicants: Yu Na Jung, Anyang-si (KR); Kyu Chul Jung, Anyang-si (KR)

(72) Inventors: Yu Na Jung, Anyang-si (KR); Kyu Chul Jung, Anyang-si (KR)

( * ) Notice: Subject to any disclaimer, the term of this patent is extended or adjusted under 35 U.S.C. 154(b) by 182 days.

(21) Appl. No.: 18/730,646

(22) PCT Filed: Jan. 31, 2023

(86) PCT No.: PCT/KR2023/001373
§ 371 (c)(1),
(2) Date: Jul. 19, 2024

(87) PCT Pub. No.: WO2023/153693
PCT Pub. Date: Aug. 17, 2023

(65) Prior Publication Data

US 2026/0167391 A1 Jun. 18, 2026

(30) Foreign Application Priority Data

Feb. 10, 2022 (KR) ..... 10-2002-0017384

(51) Int. Cl.
*B65D 43/02* (2006.01)
*B65D 43/16* (2006.01)
(Continued)

(52) U.S. Cl.
CPC ..... *B65D 43/0212* (2013.01); *B65D 43/16* (2013.01); *B65D 51/18* (2013.01);
(Continued)

(58) Field of Classification Search
CPC .... B65D 46/0212; B65D 43/16; B65D 51/18; B65D 53/02; B65D 2251/0081;
(Continued)

(56) References Cited

U.S. PATENT DOCUMENTS 3,368,341 A * 2/1968 Goebel ..... D01D 7/02 57/76
4,293,079 A * 10/1981 Lytle ..... B65D 43/169 220/833
(Continued)

FOREIGN PATENT DOCUMENTS

JP 2009-062084 A 3/2009
JP 2017-522960 A 8/2017
(Continued)

*Primary Examiner* — Ernesto A Grano
(74) *Attorney, Agent, or Firm* — PARK LAW FIRM

(57) ABSTRACT

The present invention relates to a rotational opening/closing structure of a cover for a packaging container having a non-circular type inlet, the structure comprising: one or more first opening restraining ribs (116) formed on the outer circumferential surface of an inlet (114) to protrude in the vertical direction thereof while having appropriate intervals therebetween; one or more first engagement pieces (118), each of which has an outer side surface (119) having a shape narrowing in the opening direction of a cover (120) and which are arranged and formed between the first opening restraining ribs (116) to protrude in the horizontal direction thereof while having appropriate intervals therebetween; second opening restraining ribs (122) formed on the inner circumferential surface of the cover (120) to protrude in the vertical direction, and engaged and released in a manner er of crossing the first opening restraining ribs (116) at the time of the opening or closing operation by the rotation of the cover; and second engagement pieces (124) formed between the second opening restraining ribs (122) to protrude in the
(Continued)

horizontal direction, and forcibly engaged with or released from the first engagement pieces (118), respectively.

9 Claims, 9 Drawing Sheets

(51) Int. Cl.
*B65D 51/18* (2006.01)
*B65D 53/02* (2006.01)

(52) U.S. Cl.
CPC ..... *B65D 53/02* (2013.01); *B65D 2251/0021* (2013.01); *B65D 2251/0081* (2013.01); *B65D 2543/00194* (2013.01); *B65D 2543/00537* (2013.01); *B65D 2543/00824* (2013.01); *B65D 2543/00972* (2013.01)

(58) Field of Classification Search
CPC ..... B65D 2543/00194; B65D 2543/00537; B65D 2543/00824; B65D 2543/00972
USPC ..... 220/259.1
See application file for complete search history.

(56) References Cited

U.S. PATENT DOCUMENTS 4,511,032 A 4/1985 Bush
5,353,946 A * 10/1994 Behrend ..... B65D 43/169 220/326
D548,095 S * 8/2007 McGuinness ..... D9/559
D549,587 S * 8/2007 Lestelle ..... D9/520
D554,779 S * 11/2007 Derges ..... D26/9
8,061,547 B2 * 11/2011 Camp, Jr. ..... A45C 11/20 220/592.25
9,387,963 B2 * 7/2016 McBroom ..... B65D 43/22
9,440,774 B2 * 9/2016 Schick ..... B65D 77/0493
9,446,890 B1 * 9/2016 Morris, Jr. ..... B65D 51/18
9,643,771 B2 * 5/2017 Adler ..... G06Q 10/087
10,053,283 B1 * 8/2018 Stravitz ..... B65B 67/1211
10,737,812 B2 * 8/2020 Sanfilippo ..... B65B 7/2807
2008/0230505 A1 * 9/2008 Kerman ..... B65D 41/0471 215/44
2015/0017289 A1 * 1/2015 Greenberg ..... B65D 83/06 426/115
2015/0210450 A1 * 7/2015 Mercado ..... B65D 43/22 220/849
2015/0353241 A1 * 12/2015 Glaser ..... B65D 55/02 53/476
2016/0000269 A1 * 1/2016 Van Puijenbroek ... B65D 51/18 53/421
2018/0016056 A1 * 1/2018 Herlin ..... B65D 77/245
2020/0180823 A1 * 6/2020 Murphy ..... B65D 43/0231
2020/0180828 A1 * 6/2020 Cho ..... B65D 50/046

FOREIGN PATENT DOCUMENTS

KR 20-1998-0060960 U 11/1998
KR 10-2021-0149034 A 12/2021
WO 2013-066183 A1 5/2013

* cited by examiner

[Fig. 1]
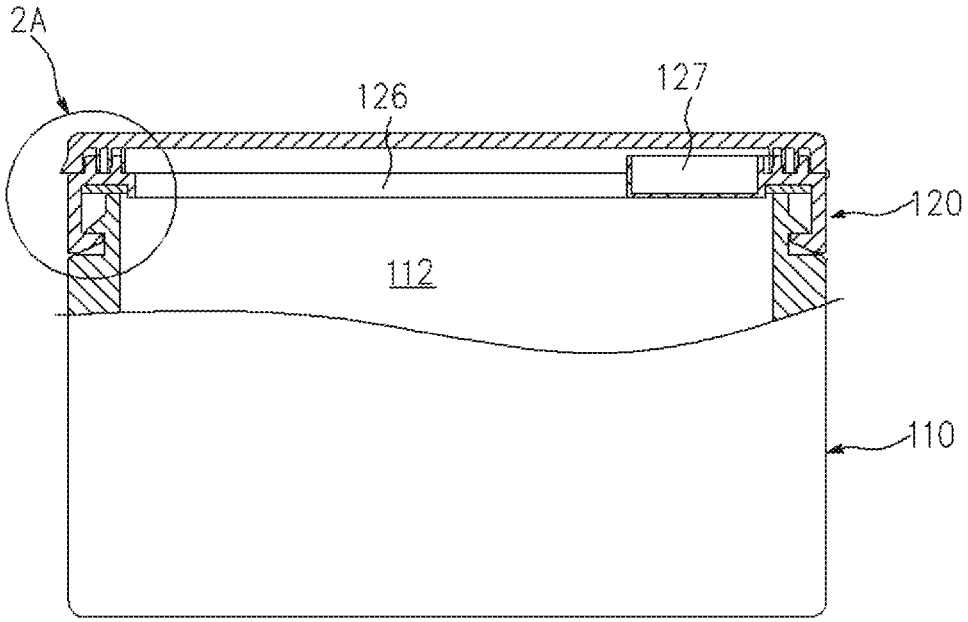

[Fig. 2]
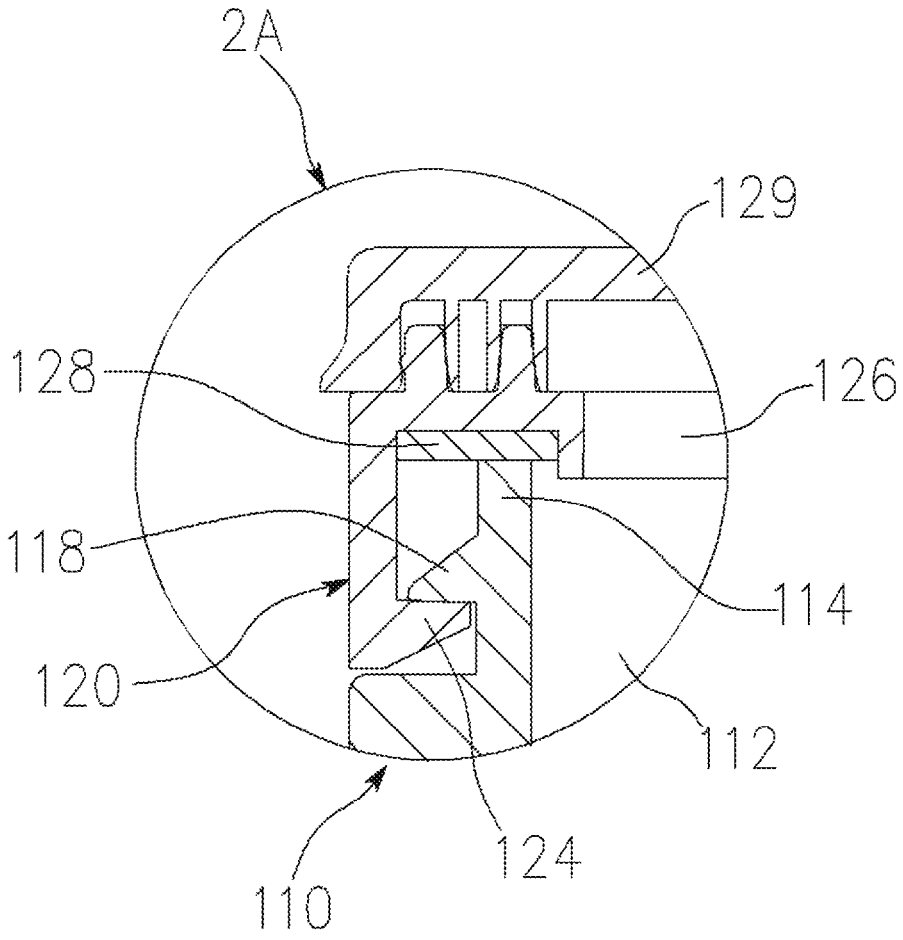

[Fig. 3]
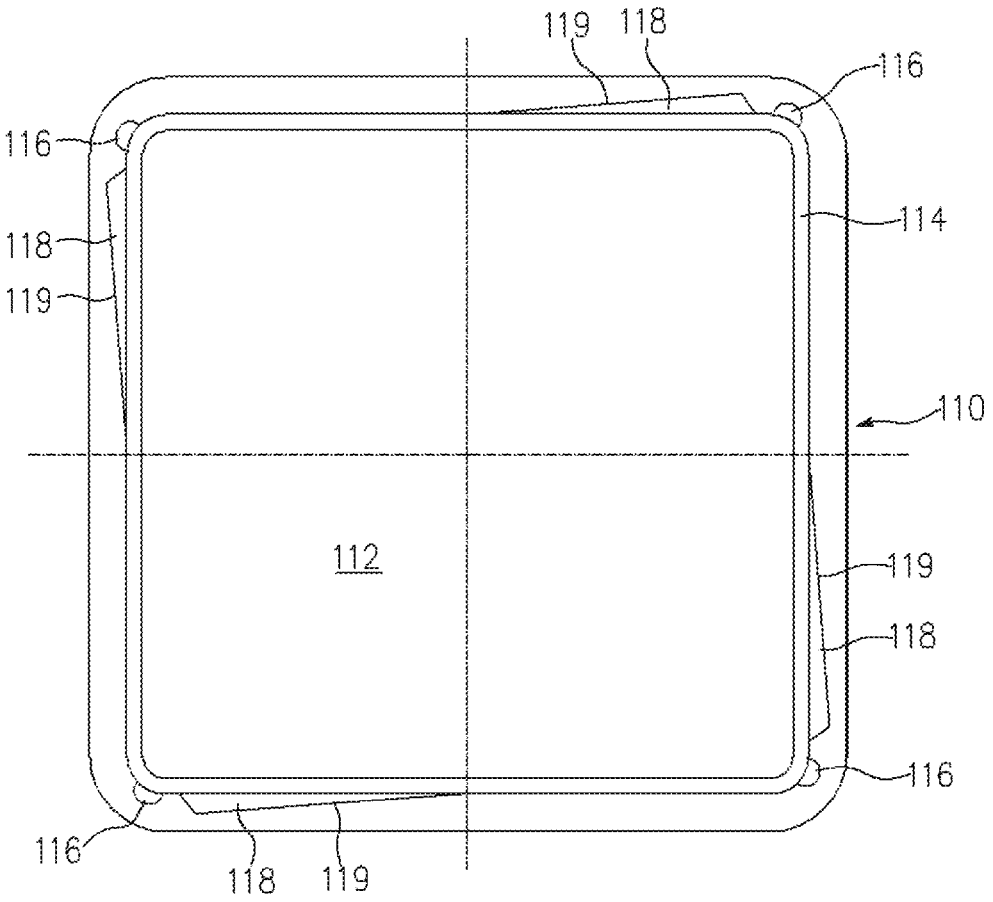

[Fig. 4]
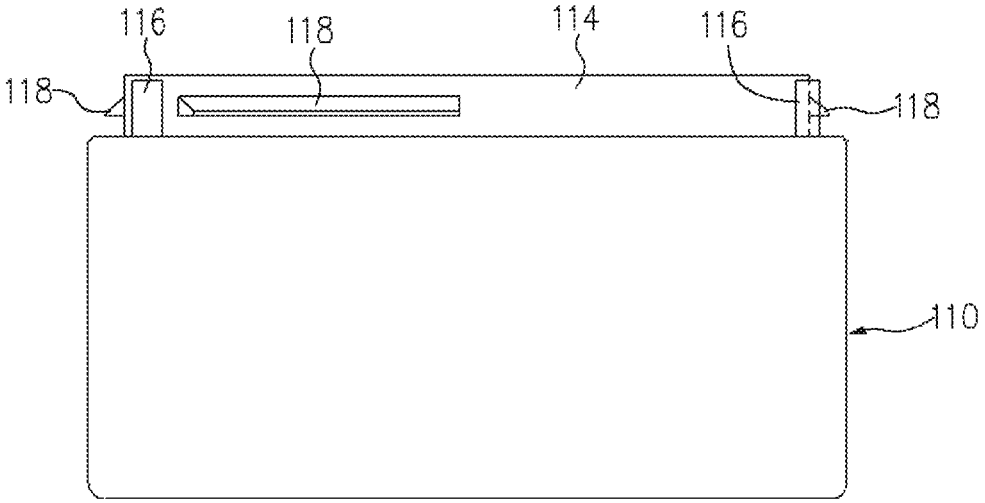

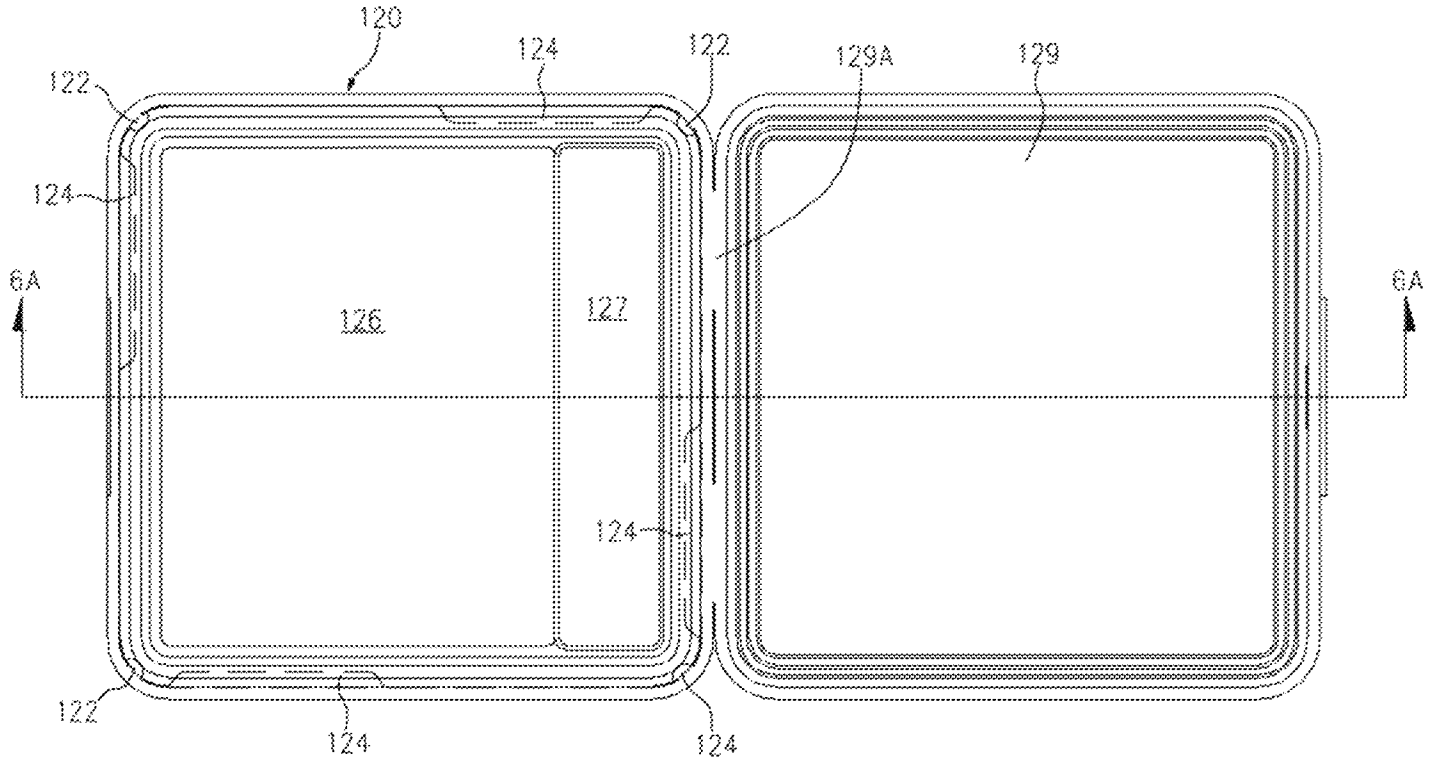
[Fig. 5]

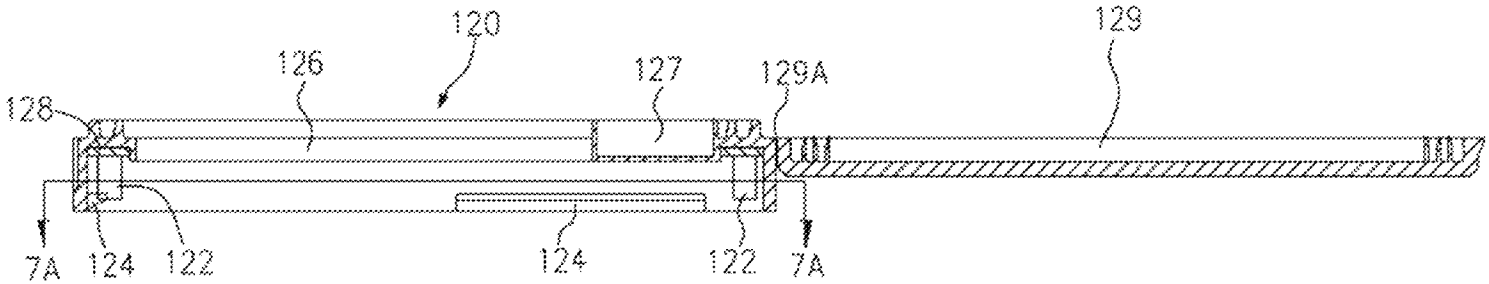
[Fig. 6]

[Fig. 7]
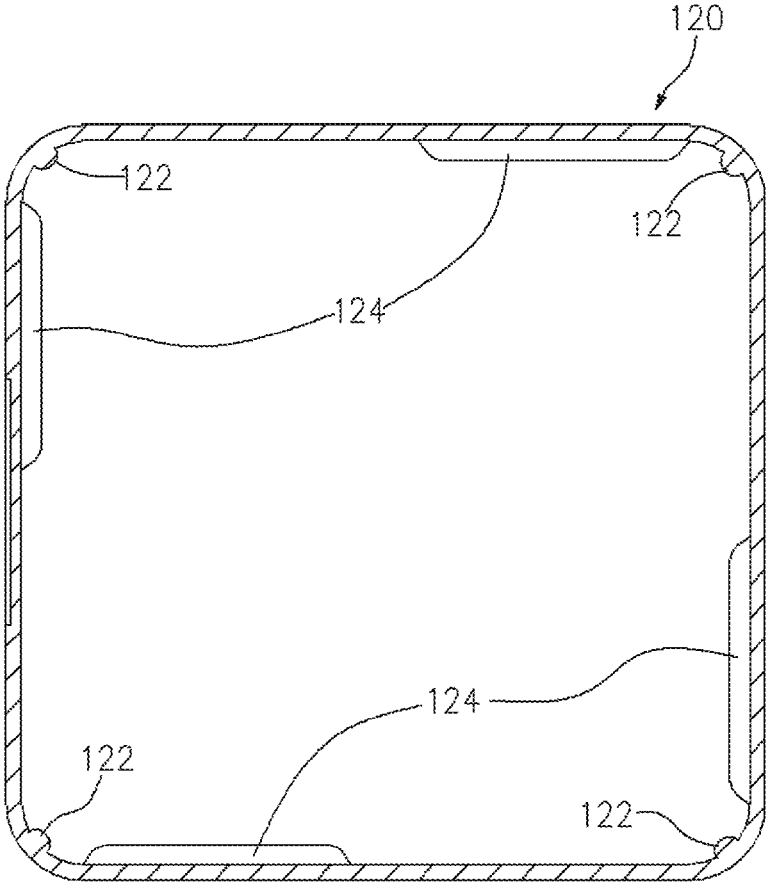

[Fig. 8]
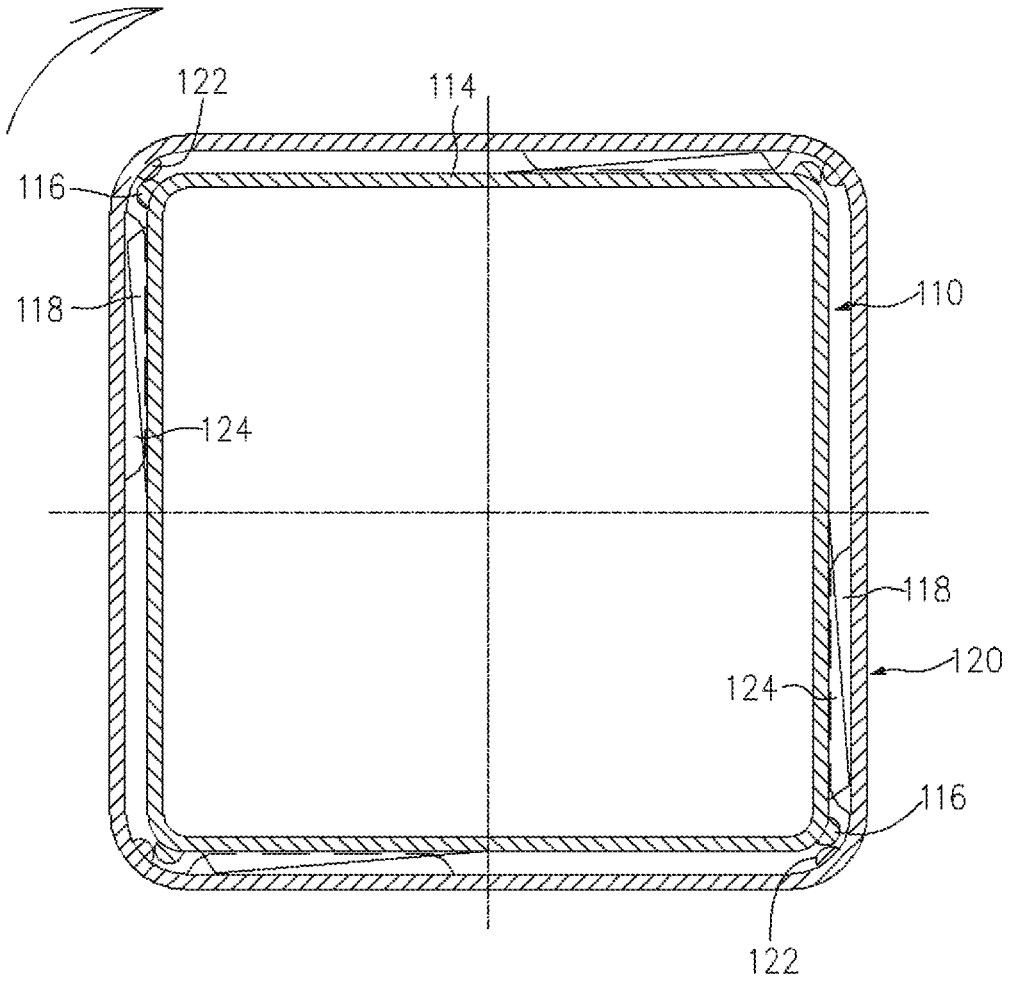

[Fig. 9]
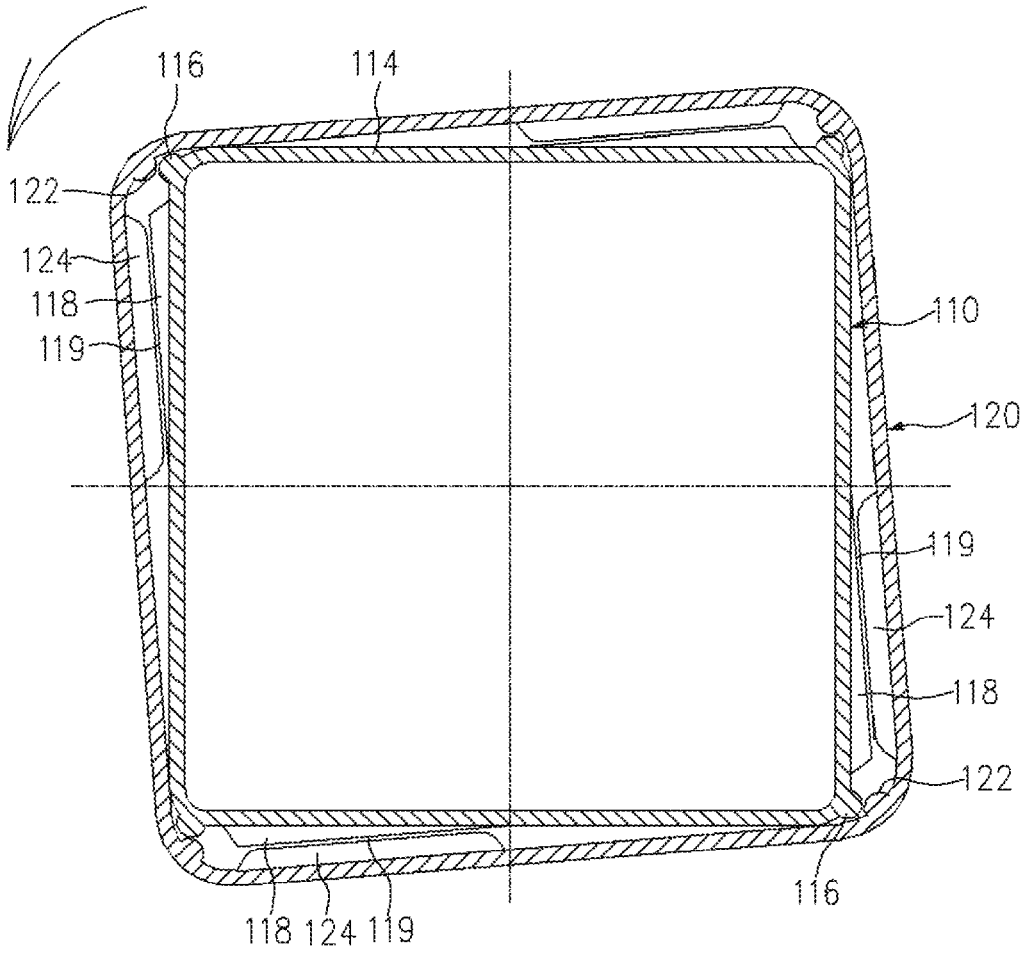

ROTATIONAL OPENING/CLOSING STRUCTURE OF COVER FOR PACKAGING CONTAINER HAVING NON-CIRCULAR-SHAPED INLET

TECHNICAL FIELD

The present disclosure relates to a rotational opening/closing structure of a cover for a packaging container having a non-circular-type inlet, the structure enabling the cover to be easily opened and closed in a rotational manner with respect to the packaging container having the non-circular-type inlet, including a polygonal type, as if opening and closing the cover with respect to an outer circumferential surface of a circular-type inlet.

BACKGROUND ART

In general, various packaging containers, including cosmetic containers, are provided with an inlet. Depending on the shape of the inlet, the method of opening and closing a cover (including a lid) varies.

For example, when the inlet is a circular type, most covers are opened and closed by rotating with respect to the circular inlet in a manner such as screwing, and when the inlet is a non-circular type, including a polygonal inlet, the cover is mainly opened and closed through an undercut method in which the cover is opened and closed in the vertical direction with respect to the inlet.

Therefore, conventionally, the inlet is mainly provided as a circular type for the convenience of opening and closing the cover, and the non-circular-type inlet is not provided, and the exterior shape of the cover is only provided as a non-circular type in consideration of the design of the cover.

In addition, due to the circular-type inlet of the packaging container, consumers are accustomed to opening and closing the cover in a rotational manner such as screwing.

DOCUMENTS OF RELATED ART

Patent Documents

1. Korean Utility Model Publication No. 20-1998-0060960 (published on Nov. 5, 1998)

DISCLOSURE

Technical Problem

Accordingly, the present disclosure has been made keeping in mind the above problems occurring in the related art, and an objective of the present disclosure is to provide a rotational opening/closing structure of a cover for a packaging container having a non-circular-type inlet, the structure enabling the cover to be quickly easily opened and closed in a rotational manner with respect to the packaging container having the non-circular-type inlet, including a polygonal type, as if opening and closing the cover with respect to a circular-type inlet.

Technical Solution order to accomplish the above objective, the present disclosure provides a rotational opening/closing structure of a cover for a packaging container having a non-circular-type inlet, the structure including: the packaging container having a packaging space configured to allow packaging contents to be accommodated therein and having the inlet formed at an open end of the packaging space, in which the inlet is formed in a non-circular type, including a polygonal type; and the cover configured to be opened and closed by rotating with respect to the inlet of the packaging container. The packaging container may include: one or more first opening restraining ribs formed an outer peripheral surface of the inlet to protrude in a vertical direction while having appropriate intervals therebetween; and one or more first engagement pieces, each of which has an outer side surface having a shape narrowing in an opening direction of the cover and which are arranged and formed between the first opening restraining ribs to protrude in a horizontal direction while having appropriate intervals therebetween, and the cover may include: one or more second opening restraining ribs formed on an inner peripheral surface thereof to protrude in a vertical direction and configured to be respectively engaged with and released from the first opening restraining ribs in a manner of crossing the first opening restraining ribs at the time of opening and closing the cover; and one or more second engagement pieces formed between the second opening restraining ribs to protrude in a horizontal direction and configured to be forcibly respectively engaged with and released from the first engagement pieces.

According to the present disclosure, the cover may further include a withdrawal space configured to allow the packaging contents to be withdrawn therefrom and used.

According to the present disclosure, the cover may further include a storage space configured to allow various tools for using the packaging contents depending on purposes to be separately stored therein and used.

According to the present disclosure, the cover may further include a packing provided therein and configured to impart high airtightness to an upper surface of the inlet of the packaging container.

According to the present disclosure, the cover may further include an auxiliary cover configured to airtightly close and open the withdrawal space and configured to be opened and closed through a hinge.

Advantageous Effects

According to the present disclosure, even when the inlet of the packaging container is formed in a non-circular type, including a polygonal type, the cover can be easily opened and closed with respect to the inlet in a rotational manner. This enables a user to open and close the cover with the same feeling as opening and closing the cover with respect to a conventional circular-type inlet. Therefore, even when the shape of the inlet varies, the user can open and close the cover quickly and easily without experiencing any discomfort or unfavorable feeling associated with the opening and closing operation of the cover, and the user's curiosity about a new opening and closing method can be encouraged.

In addition, even when the inlet of the packaging container is formed in a non-circular type, including a polygonal type, the opening and closing operation of the cover can be achieved in the same rotational opening and closing manner as in the related art, thereby providing various design possibilities for the packaging container and the cover.

DESCRIPTION OF DRAWINGS

FIG. 1 is a partially cut side sectional view illustrating a packaging container according to the present disclosure to which a cover is coupled.

FIG. 2 is an enlarged sectional view of part 2A in FIG. 1.

FIG. 3 is a plan view illustrating the packaging container according to the present disclosure.

FIG. 4 is a side view of FIG. 3.

FIG. 5 is a plan view illustrating an opened state of the cover according to the present disclosure.

FIG. 6 is a sectional view taken along line 6A-6A in FIG. 5.

FIG. 7 is a sectional view taken along line 7A-7A in FIG. 6.

FIG. 8 is a planar sectional view illustrating a state in which the cover is rotated in a closed state with respect to the inlet of the packaging container according to the present disclosure.

FIG. 9 is a planar sectional view illustrating a state in which the cover is rotated in an opened state with respect to the inlet of the packaging container according to the present disclosure.

BEST MODE

Hereinafter, an exemplary embodiment of the present disclosure will be described in detail with reference to the accompanying drawings.

Referring to FIGS. 1 to 9, a rotational opening/closing structure of a cover for a packaging container having a non-circular-type inlet according to the present disclosure includes the packaging container 110 having the non-circular-type inlet 114, including a polygonal type, and the cover 120 opened and closed by rotating with respect to the inlet 114 of the packaging container 110.

The packaging container 110 has a packaging space 112 that is open at one side thereof to accommodate various packaging contents therein.

The inlet 114 formed at an open end of the packaging space 112 extends inward in a stepped shape.

In addition, the inlet 114 may be formed in various shapes, including a quadrangular type illustrated in the drawings, a polygonal type, or a non-circular type.

According to the present disclosure, when the shape of the inlet 114 of the packaging container 110 is a non-circular type, including a polygonal type, as described above, there is significant structural limitations in implementing a cover that is opened and closed in a rotational manner.

Therefore, as will be described later, the present disclosure has a technical feature in that the cover 120 can be easily opened and closed in a rotational manner with respect to the packaging container 110 having the non-circular-type inlet 114 including a polygonal type.

To this end, the packaging container 110 includes: one or more first opening restraining ribs 116 formed on an outer peripheral surface of the non-circular-type inlet 114 including a polygonal type to protrude in the vertical direction while having appropriate intervals therebetween; and one or more first engagement pieces 118, each of which has an outer side surface 119 having a shape narrowing in the opening direction of the cover 120 and which are arranged and formed between the first opening restraining ribs 116 to protrude in the horizontal direction while having appropriate intervals therebetween.

In addition, the cover 120 includes: one or more second opening restraining ribs 122 formed on an inner peripheral surface thereof to protrude in the vertical direction and respectively engaged with and released from the first opening restraining ribs 116 formed on the inlet 114 of the packaging container 110 in a manner of crossing the first opening restraining ribs 116 at the time of opening and closing the cover 120; and one or more second engagement pieces 124 formed between the second opening restraining ribs 122 to protrude in the horizontal direction and forcibly respectively engaged with and released from the first engagement pieces 118.

Meanwhile, it has been described that the first and second engagement pieces 118 and 124 respectively formed on the outer peripheral surface of the inlet 114 and the inner peripheral surface of the cover 120 protrude in the horizontal direction for their stable engagement and release operation at the time of opening and closing the cover 120. However, the first and second engagement pieces are not limited in their terms as long as they are configured to have the engagement and release function as described above, and a horizontal angle thereof may vary, such as a shape inclined in the closing direction of the cover.

In addition, the first opening restraining ribs 116 and the second opening restraining ribs 122 are configurations for restraining arbitrary opening of the cover 120 after the closing operation of the cover 120 with respect to the inlet 114 of the packaging container 110 is completed. The first and second opening restraining ribs are not limited in their terms as long as they can achieve their function, and various modifications such as an engagement protrusion shape or an engagement groove shape other than the rib shape may be possible.

According to the rotational opening/closing structure of the cover for the packaging container having the non-circular-type inlet according to the present disclosure configured as described above, even when the inlet 114 of the packaging container 110 is formed in a non-circular type, including a polygonal type, the opening and closing operation of the cover 120 can be achieved in the same rotational opening and closing manner as in a conventional circular-type inlet. Hereinafter, the operation of the rotational opening/closing structure of the cover 120 with respect to the inlet 114 of the packaging container 110 will be described as follows.

First, refer to FIG. 8. FIG. 8 illustrates a state in which the cover 120 is rotated to a closed position with respect to the inlet 114. In this state, the second opening restraining ribs 122 formed on the inner peripheral surface of the cover 120 and the first opening restraining ribs 116 formed on the outer peripheral surface of the inlet 114 are elastically engaged with each other in a crossing manner. Therefore, unless the cover 120 is opened by intentionally applying an external force, the cover is maintained in a stably engaged state, and thus the cover can be prevented or restrained from being arbitrarily opened. In addition, the first engagement pieces 118 formed on the inlet 114 and the second engagement pieces 124 formed on the inner peripheral surface of the cover 120 are engaged with each other.

Therefore, in the state illustrated in FIG. 8, because the cover 120 is forcibly closed with respect to the inlet 114 of the packaging container 110, the cover can be prevented from being arbitrarily opened and can be maintained in a stably closed state.

Next, refer to FIG. 9. FIG. 9 illustrates a state in which the cover 120 is rotated to an opened position with respect to the inlet 114. In this state, the second opening restraining ribs 122 formed on the inner peripheral surface of the cover 120 are forcibly released from the first opening restraining ribs 116 formed on the outer peripheral surface of the inlet 114, and the first engagement pieces 118 formed on the inlet 114 and the second engagement pieces 124 formed on the inner peripheral surface of the cover 120 are also forcibly released from mutual engagement.

Therefore, in the state illustrated in FIG. 9, because an engaging force that forcibly engages the cover 120 with the inlet 114 of the packaging container 110 is completely released, the cover can be forcibly separated from the inlet 114, and the opened state of the cover provides a closed engagement position for the cover later.

In addition, when the cover 120 is in an opened state with respect to the inlet 114 as illustrated in FIG. 9, because the second opening restraining ribs 122 formed on the inner peripheral surface of the cover 120 cross the first opening restraining ribs 116 formed on the outer peripheral surface of the inlet 114 to the opened position, the cover is displaced by a rotation angle so that the engaging force is released.

As discussed in above, according to the rotational opening/closing structure of the cover for the packaging container having the non-circular-type inlet according to the present disclosure, by simply rotating the second opening restraining ribs 122 formed on the inner peripheral surface of the cover 120 so as to be easily engaged with or released from the first opening restraining ribs 116 formed on the outer peripheral surface of the inlet 114 of the packaging container 110 in a crossing manner, the rotational opening and closing operation of the cover 120 with respect to the inlet 114 becomes possible, enabling quick and easy opening and closing operations of the cover 120 while significantly reducing a rotational opening and closing operation distance thereof.

In addition, through the rotational opening/closing structure of the cover 120 as described above, even when the inlet 114 is formed in a non-circular type, including a polygonal type, it is possible to provide a novel advantage that a user is given a new feeling or curiosity of manipulation when rotationally opening and closing the cover 120 without experiencing any discomfort or unfavorable feeling associated with the rotational opening and closing operation of the cover 120. Also, by implementing the cover 120 to be opened and closed in a rotational manner as described above, it is possible to provide various designs of the cover 120 as well as the packaging container 110.

Meanwhile, according to the present disclosure, the cover 120 may further include a withdrawal space 126 that allows packaging contents to be withdrawn therefrom and used.

In addition, according to the present disclosure, the cover 120 may further include a storage space 127 that allows using various tools for using packaging contents depending on purposes to be separately stored therein and used.

In addition, according to the present disclosure, the cover 120 may further include a packing 128 that is provided on the inner peripheral surface thereof and imparts high airtightness to an upper surface of the inlet 114 of the packaging container 110.

In addition, according to the present disclosure, the cover 120 may further include an auxiliary cover 129 that airtightly closes and opens the withdrawal space 126 and is opened and closed through a hinge 129A.

Although the preferred embodiment of the present disclosure has been disclosed for illustrative purposes, those skilled in the art will appreciate that various modifications, additions, and substitutions are possible, without departing from the scope and spirit of the present disclosure as disclosed in the accompanying claims.

DESCRIPTION OF THE REFERENCE NUMERALS IN THE DRAWINGS

110: packaging container 112: packaging space
114: inlet 116: first opening restraining rib
118: first engagement piece 119: outer side surface of first engagement piece
120: cover 122: second opening restraining rib
124: second engagement piece 126: withdrawal space
127: storage space 128: packing
129: auxiliary cover 129A: hinge

The invention claimed is:

1. A rotational opening/closing structure of a cover for a packaging container having a non-circular-shaped inlet, the structure comprising:

the packaging container (110) having a packaging space (112) configured to allow packaging contents to be accommodated therein and having the non-circular-shaped inlet (114) formed at an open end of the packaging space, wherein the non-circular-shaped inlet is formed in a non-circular shape, including a polygonal shape; and the cover (120) configured to be opened and closed by rotating with respect to the non-circular-shaped inlet (114) of the packaging container, wherein the packaging container comprises:

one or more first opening restraining ribs (116) formed on an outer peripheral surface of the non-circular-shaped inlet (114) to protrude in a vertical direction while having appropriate intervals therebetween; and one or more first engagement pieces (118), each of which has an outer side surface (119) having a shape narrowing in an opening direction of the cover (120) and which are arranged and formed between the first opening restraining ribs (116) to protrude in a horizontal direction while having intervals therebetween, and the cover (120) comprises:

one or more second opening restraining ribs (122) formed on an inner peripheral surface thereof to protrude in a vertical direction and configured to be respectively engaged with and released from the first opening restraining ribs (116) in a manner of crossing the first opening restraining ribs at the time of opening and closing the cover; and one or more second engagement pieces (124) formed between the second opening restraining ribs (122) to protrude in a horizontal direction and configured to be forcibly respectively engaged with and released from the first engagement pieces (118).

2. The structure of claim 1, wherein the cover (120) further comprises a withdrawal space (126) configured to allow the packaging contents to be withdrawn therefrom and used.

3. The structure of claim 2, wherein the cover (120) further comprises a storage space (127) configured to allow various tools for using the packaging contents depending on purposes to be separately stored therein and used.

4. The structure of claim 3, wherein the cover (120) further comprises a packing (128) provided therein and configured to impart high airtightness to an upper surface of the non-circular-shaped inlet (114) of the packaging container (110).

5. The structure of claim 4, wherein the cover (120) further comprises an auxiliary cover (129) configured to airtightly close and open the withdrawal space (126) and configured to be opened and closed through a hinge (129A).

6. The structure of claim 2, wherein the cover (120) further comprises a packing (128) provided therein and configured to impart high airtightness to an upper surface of the non-circular-shaped inlet (114) of the packaging container (110).

7. The structure of claim 6, wherein the cover (120) further comprises an auxiliary cover (129) configured to airtightly close and open the withdrawal space (126) and configured to be opened and closed through a hinge (129A).

8. The structure of any one of claims claim 1, wherein the cover (120) further comprises a packing (128) provided therein and configured to impart an increased airtightness to an upper surface of the non-circular-shaped inlet (114) of the packaging container (110).

9. The structure of claim 8, wherein the cover (120) further comprises an auxiliary cover (129) configured to airtightly close and open the withdrawal space (126) and configured to be opened and closed through a hinge (129A).

* * * * *